US007971551B2

(12) United States Patent
Mauchle et al.

(10) Patent No.: US 7,971,551 B2
(45) Date of Patent: Jul. 5, 2011

(54) POWDER SPRAY COATING APPARATUS AND POWDER SPRAY COATING METHOD

(75) Inventors: Felix Mauchle, Abtwil (CH); Mark Steinemann, Hofstetten (CH)

(73) Assignee: Illinois Tool Works Inc., Glenview, IL (US)

( * ) Notice: Subject to any disclaimer, the term of this patent is extended or adjusted under 35 U.S.C. 154(b) by 435 days.

(21) Appl. No.: 12/023,291

(22) Filed: Jan. 31, 2008

(65) Prior Publication Data

US 2008/0187658 A1 Aug. 7, 2008

(30) Foreign Application Priority Data

Feb. 2, 2007 (DE) ..... 10 2007 005 309

(51) Int. Cl.
*B05C 11/10* (2006.01)

(52) U.S. Cl. ..... 118/308; 118/693; 118/694; 118/698; 427/180

(58) Field of Classification Search ..... 118/602, 118/693, 694, 698; 427/180
See application file for complete search history.

(56) References Cited

U.S. PATENT DOCUMENTS

| | | | | |
|---|---|---|---|---|
| 3,918,641 | A | 11/1975 | Lehmann et al. | |
| 3,960,323 | A * | 6/1976 | Ducan et al. | 239/3 |
| 5,454,256 | A * | 10/1995 | Gimben et al. | 73/29.01 |
| 6,129,946 | A | 10/2000 | Adams | |
| 6,508,610 | B2 | 1/2003 | Dietrich | |
| 2002/0014200 | A1 * | 2/2002 | Stemler et al. | 118/52 |
| 2006/0193704 | A1 * | 8/2006 | Simontacchi | 406/88 |

FOREIGN PATENT DOCUMENTS

| | | | |
|---|---|---|---|
| CH | 529 590 | A | 10/1972 |
| CH | 529590 | * | 10/1972 |
| DE | 693 29 808 | T2 | 6/1992 |
| DE | 42 39 496 | A1 | 5/1994 |
| DE | 195 17 229 | A1 | 11/1996 |
| DE | 101 45 448 | A1 | 5/2003 |
| DE | 10353968 | A | 7/2005 |
| EP | 0 412 289 | A2 | 7/1990 |
| EP | 0 412 279 | A2 | 2/1991 |
| EP | 0 606 577 | A1 | 7/1994 |
| EP | 195 81 792 | T1 | 10/1994 |
| JP | 2007286424 | A * | 11/2007 |
| WO | 97/12693 | A1 | 4/1997 |
| WO | 2005/051549 | A1 | 6/2005 |

OTHER PUBLICATIONS

Search report dated May 29, 2008 for PCT/IB2008/000015.
Search report dated May 29, 2008 for 07120752.6-1268.

* cited by examiner

*Primary Examiner* — Dah-Wei D Yuan
*Assistant Examiner* — Charles J Capozzi
(74) *Attorney, Agent, or Firm* — Barnes & Thornburg LLP

(57) ABSTRACT

A powder spray coating facility is automatically switched between a first operating mode in which only recovery powder is moved into an intermediate receptacle, and a second operating mode in which only fresh powder from a fresh powder unit is fed to the intermediate receptacle. Switching may be carried out from the second operating mode to a reserve powder operating mode when, following switching from the first operating mode to the second operating mode, an intermediate receptacle sensor continues to transmit a "powder needed" signal.

20 Claims, 2 Drawing Sheets

POWDER SPRAY COATING APPARATUS AND POWDER SPRAY COATING METHOD

CROSS REFERENCE TO RELATED APPLICATIONS

This application claims the benefit under the Paris Convention of the Feb. 2, 2007 filing date of German patent application 10 2007 005 309.8. The disclosure of German patent application 10 2007 005 309.8 is hereby incorporated herein by reference.

FIELD OF THE INVENTION

The present invention relates to powder spray coating apparatus, sometimes referred to hereafter as a "powder spray coating facility".

BACKGROUND OF THE INVENTION

Powder spray coating facilities are known for instance from the documents U.S. Pat. No. 3,918,641; EP 0 412 289 B2; DE 42 39 496 A1 and DE 103 53 968 A1.

The present invention seeks to render powder spray coating facilities and powder spray coating methods more efficient.

DISCLOSURE OF THE INVENTION

According to an aspect of the invention, a powder spray coating facility comprises an intermediate receptacle from which coating powder may be pneumatically moved at least to one sprayer, at least one sensor at the intermediate receptacle to generate a "powder needed" signal when the powder level in the intermediate receptacle has dropped below a predetermined minimum level, a cyclone separator to separate recovery powder from an airflow containing sprayed, excess powder that missed an object being coated, and a recovery powder supply bin configured in the path of the recovery powder from the cyclone separator to the intermediate receptacle. The recovery powder supply bin acts as an interim storage for the recovery powder in the recovery powder supply bin before the recovery powder is fed into the intermediate receptacle. The recovery powder supply bin is fitted with at least one supply bin sensor to generate a recovery powder data signal based on whether the powder level is at or below a minimum level. The powder spray coating facility further includes a fresh-powder feed which serves to feed unsprayed fresh powder from a fresh powder container into the intermediate receptacle along at least one powder path which bypasses both the cyclone separator and the powder recovery supply bin, and at least one control operationally connected to the sensors to automatically drive the powder spray coating facility. The at least one control includes a first operational mode in which only recovery powder from the recovery powder supply bin is fed into the intermediate receptacle, but no fresh powder from the fresh powder feed unit, when simultaneously there is a "powder needed" signal from the intermediate receptacle sensor and a recovery powder data signal from the recovery powder supply bin sensor. The recovery powder data signal corresponds to a recovery powder level at or above the predetermined minimum level of recovery powder. The at least one control further includes a second operational mode in which only fresh powder is fed from the fresh powder supply unit to the intermediate receptacle, but no recovery powder from the recovery powder supply bin if there is a "powder needed" signal from the intermediate receptacle sensor and simultaneously there is a recovery powder data signal from the supply bin sensor, where the recovery powder data signal corresponds to a recovery powder level below the said minimum level.

Illustratively, the at least one supply bin sensor is configured at such a height on the recovery powder supply bin that the recovery powder supply bin comprises a powder reserve segment situated below the supply bin sensor. The powder reserve segment stores a predetermined quantity of reserve recovery powder up to said minimum level.

Illustratively, the at least one control automatically switches the powder spray coating facility from the second operating mode into reserve operating mode wherein the intermediate receptacle receives only recovery powder from the powder reserve segment of the recovery powder supply bin but no fresh powder from the fresh powder supply unit when, following a predetermined time delay after switching from the first operating mode to the second operating mode, there continues to be a "powder needed" signal from the intermediate receptacle sensor. The at least one control is fitted with a time delay circuit defining the time delay or the time delay is adjusted at said circuit.

Illustratively, the recovery powder supply bin is fitted with a second supply bin sensor for generating an emergency signal anytime the recovery powder level in the recovery powder supply bin has dropped to a predetermined lower limit level situated at a predetermined distance below the predetermined recovery powder minimum level of the first supply bin sensor.

Illustratively, the recovery powder supply bin is oriented underneath the cyclone separator and a vertical passage is subtended between the recovery powder supply bin and the cyclone separator through which the recovery powder is allowed to drop by gravity from the cyclone separator into the recovery powder supply bin.

Illustratively, the recovery powder supply bin is fitted with a container housing comprising a lower extension of the housing of the cyclone separator.

Illustratively, the housing of the recovery powder supply bin tapers from top to bottom in a frustoconical manner.

Illustratively, the recovery powder supply bin is fitted with a fluidizing unit to fluidize, by compressed air, recovery powder present in the recovery powder supply bin. The compressed air is fed through the fluidizing unit into the recovery powder supply bin.

Further illustratively, the powder spray coating facility includes a blocking device in the form of at least one pinch valve mounted at the lower end of the recovery powder supply bin and operable alternately to block and open a powder outlet.

Illustratively, at least one of the at least one intermediate receptacle sensor and the at least one supply bin sensor is a powder level sensor generating the said signals as a function of the powder levels it detects.

Illustratively, the fresh powder supply unit is fitted with a sensor generating a first signal as a function of the quantity of fresh powder in a fresh powder container in the fresh powder supply unit when the quantity of fresh powder in the fresh powder container drops below a predetermined residual quantity.

Illustratively, the sensor of the fresh powder supply unit is operationally connected to the at least one control and generates a second signal in the at least one control when the quantity of fresh powder in the fresh powder container has decreased to a lower quantity limit value that is a particular distance below a predetermined residual quantity at which said first signal is being generated.

Illustratively, upon receiving the second signal from the sensor of the fresh powder supply unit, the at least one control switches the powder spray coating facility to a mode of reserve operation provided a "powder needed" signal is also generated by the at least one intermediate receptacle sensor. During the mode of reserve operation, only recovery powder from the powder reserve segment of the recovery powder supply bin is fed to the intermediate receptacle. No fresh powder from the fresh powder supply unit is fed to the intermediate receptacle.

Illustratively, the sensor of the fresh powder supply unit is operationally connected to the at least one control and the at least one control is so designed that in response to the first signal from the sensor of the spray coating facility's fresh powder supply unit the at least one control switches the spray coating facility to the reserve mode, provided the at least one intermediate receptacle sensor also generates a "powder needed" signal, where, in the reserve mode only recovery powder from the powder reserve segment of the recovery powder supply bin is fed to the intermediate receptacle, but no fresh powder from the fresh powder supply unit is fed to the intermediate receptacle.

Illustratively, the sensor of the fresh powder supply unit is operationally connected to the at least one control. The at least one control is designed in a manner that, in response to the first signal from the sensor of the fresh powder supply unit, the at least one control switches the spray coating facility to a reserve mode provided a "powder needed" signal is also generated by the at least one intermediate receptacle sensor. In the reserve mode only recovery powder from the powder reserve segment of the recovery powder supply bin is fed to the intermediate receptacle. No fresh powder from the fresh powder unit is fed to the intermediate receptacle. The control contains a time delay circuit as a result of which the switching to the reserve mode takes place only after a predetermined time delay following receiving the first signal of the sensor of the fresh powder supply.

Illustratively, the sensor of the fresh powder supply unit comprises a scale weighing the fresh powder in a fresh powder container.

Illustratively, a sieve is oriented in the path followed by the recovery powder from the recovery powder supply bin to the intermediate receptacle.

Illustratively, the path followed by the fresh powder from the fresh powder supply unit to the intermediate receptacle also passes through the sieve so that the fresh powder also will be sifted.

Further illustratively, a powder pump is oriented in a powder path segment of the recovery powder from the recovery powder supply bin to the intake side of the sieve.

Further illustratively, a powder pump is oriented in each said powder path segment of the fresh powder from the fresh powder container of the fresh powder supply unit to the intake side of the sieve.

Illustratively, the powder spray coating facility includes one powder pump in each powder path segment from an output side of the sieve into the intermediate receptacle.

Illustratively, the powder spray coating facility includes one powder pump in each coating powder path from the intermediate receptacle to the at least one sprayer.

According to another aspect of the invention, a powder spray coating method is provided to operate a powder spray coating facility in which coating powder is pneumatically moved from an intermediate receptacle to at least one sprayer. Also in the powder spray coating facility, at least one sensor at the intermediate receptacle generates a "powder needed" signal when the powder level in the intermediate receptacle drops below a predetermined coating powder level. Also in the powder spray coating facility, a cyclone separator separates recovery powder from an airflow. The recovery powder contains sprayed excess powder that missed an object being coated. The method includes temporarily holding the recovery powder in a recovery powder supply bin, generating a recovery powder data signal as a function of the powder level in the recovery powder supply bin being at or below a minimum level, and feeding unsprayed fresh powder from a fresh powder container to the intermediate receptacle along a powder path bypassing the cyclone separator and the recovery powder supply bin. The method further includes automatically driving the powder spray coating facility in a first operating mode in which the intermediate receptacle receives only recovery powder from the recovery powder supply bin but no fresh powder from the fresh powder supply unit when the intermediate receptacle sensor transmits a "powder needed" signal and simultaneously the recovery powder supply bin sensor transmits a recovery powder data signal which corresponds to a recovery powder level at or above the predetermined minimum level. The method further includes automatically switching the powder spray coating facility into a second operating mode and operating the powder spray coating facility in said second mode in which only fresh powder from the fresh powder supply unit is fed to the intermediate receptacle but no recovery powder from the recovery powder supply bin when the intermediate receptacle sensor transmits a "powder needed" signal and simultaneously the recovery powder supply bin sensor transmits a recovery powder data signal which corresponds to a recovery powder level below the said minimum recovery powder level.

Further illustratively, the method includes storing a reserve quantity of recovery powder in a lower powder reserve segment of the recovery powder supply bin during the first operating mode and automatically switching from the second operating mode into a reserve operating mode during which the intermediate receptacle only receives recovery powder from the reserve quantity of recovery powder of the powder reserve segment but no fresh powder from the fresh powder supply unit when, following a predetermined delay time after switching from the first operating mode to the second operating mode a "powder needed" signal is still being transmitted from the intermediate receptacle sensor.

BRIEF DESCRIPTION OF THE DRAWINGS

The present invention is elucidated below by illustrative embodiments and in relation to the drawings.

DETAILED DESCRIPTIONS OF ILLUSTRATIVE EMBODIMENTS

Figure 1:
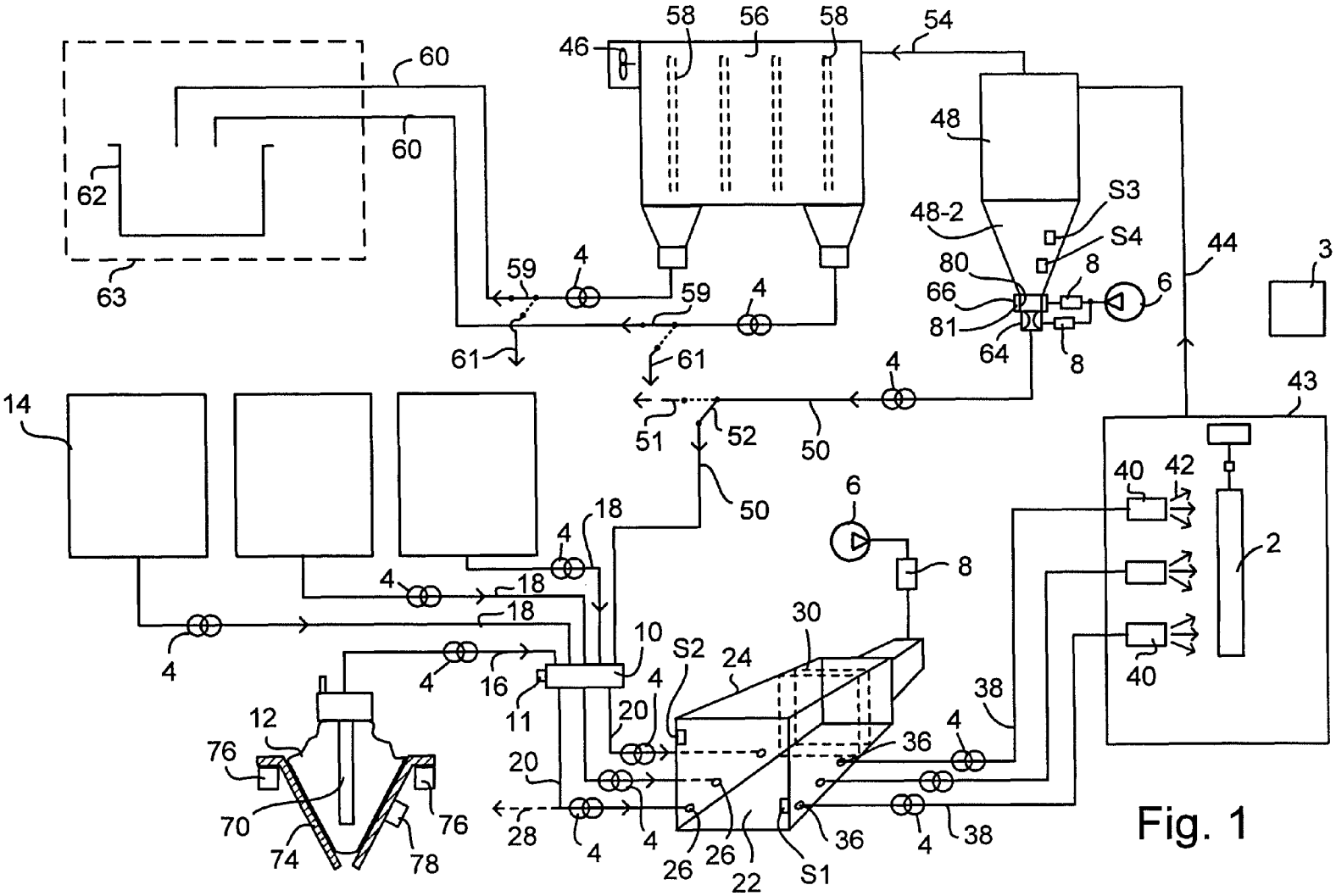
FIG. 1 schematically shows a powder spray coating facility constructed according to the present invention, and FIG. 2 schematically shows an enlarged detail of FIG. 1.

FIG. 1 schematically shows a powder spray coating facility of the invention to spray coat objects 2 with coating powder which is subsequently fused in an oven onto said object. One or more electronic control(s) 3 are used to drive the operations of the powder spray coating facility. Powder pumps 4 pneumatically move the coating powder. Said pumps may be injectors wherein compressed air acting as the conveying air aspirate coating powder from a powder container, whereupon the mixture of conveying air and coating powder jointly flows into a container or toward a sprayer.

Illustratively such injectors are known from the European patent document EP 0 412 289 B1.

The powder pump(s) used may be the kind that sequentially move small doses of powder, each small powder dose (quantity of powder) being stored in a powder chamber and then being expelled by compressed air from the powder chamber. The compressed air remains behind the powder dose and pushes it ahead. Such pumps occasionally are called compressed-air thrust pumps or plug moving pumps because the compressed air pushes the stored powder dose like a plug/stopper before it through a pump outline conduit. Various kinds of powder pumps moving packed coating powder are illustratively known from the following documents: DE 103 53 968 A1; U.S. Pat. No. 6,508,610 B2; US 2006/0193704 A1; DE 101 45 448 A1 and WO 2005/051549 A1.

The invention is not restricted to one of the above cited pump types.

A source of compressed air 6 is used to generate the compressed air to pneumatically move the coating powder and to fluidize it, said source being connected to the various components by corresponding pressure adjusting elements 8 such as pressure regulators and/or valves.

Fresh powder from the manufacturer is fed from a vendor's container—which may be a small container 12, for instance a dimensionally stable container or a bag holding for instance 10 to 50 kg powder, for instance 25 kg, or for instance a large container 14 also dimensionally stable or a bag holding for instance between 100 kg and 1,000 kg powder—by means of a powder pump 4 in a fresh powder conduit 16 or 18 to a sieve 10. The sieve 10 may be fitted with a vibrator 11. Herein the expressions "small container" and "large container" denote both dimensionally stable containers and those which are not, such as flexible bags, unless as otherwise noted.

The coating powder sifted through the sieve 10 is moved by gravity or by a powder pump 4 through one or more powder feed conduits 20 through powder intake apertures 26 into an intermediate receptacle chamber 22 of a dimensionally stable intermediate receptacle 24. Preferably the volume subtended by the intermediate receptacle 22 is substantially smaller than that of the fresh powder small container 12.

In an embodiment of the invention, the powder pump 4 of the minimum of one powder feed conduit 20 leading to the intermediate receptacle 24 is a compressed air pump. In this instance the initial segment of the powder feed conduit 20 may serve as a pump chamber which receives the powder sifted through the sieve 10 as it drops through a valve, for instance a pinch valve. Once this pump chamber contains a given powder portion, the powder feed conduit 20 is shut off from the sieve 10 due to valve closure. Next the powder portion is forced by compressed air through the powder feed conduit 20 into the intermediate receptacle chamber 22.

Illustratively, the powder intake apertures 26 are configured in a side wall of the intermediate receptacle 24 near the bottom of the intermediate receptacle chamber 22, so that, when compressed-air flushes the intermediate receptacle chamber 22, even powder residues at the bottom can be expelled through the powder intake apertures 26, and for that purpose the powder feed conduits 20 are separated from the sieve 10 and directed into a waste vessel as indicated by a dashed arrow 28 in FIG. 1. The intermediate receptacle chamber 22 is cleaned for instance by a plunger 30 that is fitted with compressed air nozzles and is displaceable through the intermediate receptacle chamber 22.

Powder pumps 4, for instance injectors, are connected to one or more powder outlet apertures 36 to move coating powder through powder conduits 38 to the sprayers 40. The sprayers 40 may be fitted with spray nozzles or rotary atomizers to spray coating powder 42 onto the object 2 to be coated, said object being situated in a coating cabin 43. The powder outlet apertures 36 are situated in a wall that is opposite the wall containing the powder intake apertures 26. The powder outlet apertures 36 also are configured near the bottom of the intermediate receptacle chamber 22

Illustratively, the size of the intermediate receptacle chamber 22 allows storing coating powder in amounts between 1.0 and 12 kg, illustratively between 2.0 and 8.0 kg. In other words, the size of the intermediate receptacle chamber 22 illustratively shall be between 500 and 30,000 $cm^3$, illustratively between 2,000 and 20,000 $cm^3$. The size of the intermediate receptacle chamber 22 is selected as a function of the number of powder outlet apertures 36 and of powder conduits 38 connected to them in a manner to allow continuous spray coating while also allowing rapidly cleaning the intermediate receptacle chamber 22 during pauses of operation for purposes of powder changes, illustratively in automated manner. The intermediate receptacle chamber 22 may be fitted with a fluidizing means to fluidize the coating powder.

Coating powder 42 failing to adhere to the object 2 is aspirated as excess powder through an excess powder conduit 44 by means of a flow of suction air from a blower 46 into a cyclone separator 48. In the cyclone separator, the excess powder is separated as much as possible from the suction flow. The separated powder proportion is then moved as recovery powder from the cyclone separator 48 through a recovery powder conduit 50 to the sieve 10 and from there it passes through said sieve either by itself or admixed to fresh powder, through the powder feed conduits 20 once more, into the intermediate receptacle chamber 22.

Depending on the kind of powder and/or the intensity of powder soiling, the powder recovery conduit 50 also may be separated from the sieve 10 and the recovery powder may be moved into a waste vessel as schematically indicated by a dashed line 51 in FIG. 1. In order that the powder recovery conduit 50 need not be separated from the sieve 10, it may be fitted with a switch 52 allowing connecting it either to the sieve 10 or to a waste vessel.

The intermediate receptacle 24 may be fitted with one or more sensors, for instance two sensors S1 and/or S2 to control feeding coating powder into the intermediate receptacle chamber 22 by means of the control 3 and the powder pumps 4 in the powder feed conduits 20. Illustratively the lower sensor S1 detects a lower powder level limit and the upper sensor S2 detects an upper powder level limit.

The lower end segment 48-2 of the cyclone separator 48 can be designed and used as a recovery powder supply bin and be used as such and be fitted for that purpose with one or several illustratively two sensors S3 and/or S4 which are operationally connected to the control 3. As a result the fresh powder feed through the fresh powder feed conduits 16 and 18 may be blocked, especially in automated manner, until enough recovery powder shall accumulate in the cyclone separator 48 to feed through the sieve 10 enough recovery powder into the intermediate receptacle chamber 22 for spraycoating by the sprayer 40. Once the recovery powder becomes insufficient in the cyclone separator 48 for such operation, the switchover to the fresh powder feed through the fresh powder conduits 16 or 18 may automatically kick in. The invention also offers the possibility to simultaneously feed fresh and recovery powders to the sieve 10 to mix them.

The exhaust air of the cyclone separator 48 passes through an exhaust air conduit 54 into a post filtration system 56 and therein through one or more filter elements 58 to arrive at the blower 46 and beyond latter into the atmosphere. The filter elements 58 may be filter bags or filter cartridges of filter plates or similar elements. Ordinarily the powder separated from the air flow by means of the filter elements 58 is waste powder and drops by gravity into a waste vessel, or, as shown in FIG. 1 it may be moved by means of one or several waste conduits 60 each fitted with a powder pump 4 into a waste vessel 62 at a waste station 63.

Depending on the kind of powder and on the powder coating conditions, the waste powder also may be recovered and moved to the sieve 10 in order to be recirculated into the coating circuit. This feature is schematically indicated in FIG. 1 by switches 59 and branch conduits 61 of the waste conduits 60.

Typically only cyclone separators 48 and the post filtration system 56 are used for multicolor operation, wherein different colors each are sprayed only for a short time, and the waste powder of the post filtration system 56 is moved into the waste vessel 62. In general the powder-separating efficiency of the cyclone separator 48 is less than that of the post filtration system 56, but cleaning is more rapid than in the post filtration system 56. As regards monochrome operation, wherein the same powder is used for a long time, the cyclone separator 48 may be dispensed with, and the excess powder conduit 44 instead of the exhaust air conduit 54 may be connected to the post filtration system 56, and the waste conduits 60—which in this instance contain recovery powder—act as powder recovery conduits to the sieve 10. Typically the cyclone separator 48 is used in combination with the post filtration system 56 in monochrome operation only when the coating powder entails problems. In such eventuality only the recovery powder of the cyclone separator 48 is moved through the powder recovery conduit 50 to the sieve 10 whereas the waste powder of the post filtration system 56 is moved into the waste vessel 62 or into another waste vessel, said waste vessel being optionally free of waste conduits 60 and directly positioned underneath an outlet aperture of the post filtration system 56.

The lower end of the cyclone equipment 48 may be fitted with an outlet valve 64, for instance a pinch valve. Moreover fluidizing means 66 to fluidize the coating powder may be configured above said outlet valve 64, in or at the lower end segment 48-2, constituted as a supply bin of the cyclone separator 48. The fluidizing means 66 contains at least one fluidizing wall 80 made of material comprising open pores or fitted with narrow boreholes, this material being permeable to compressed air but not to the coating powder. The fluidizing wall 80 is situated between the powder path and a fluidizing compressed air chamber 81. The fluidizing compressed air chamber 81 may be connected by a compressed air adjusting element 8 to the compressed air source 6.

For the purpose of aspirating fresh coating powder, the fresh powder conduit 16 and/or 18 may be connected to allow powder flow at is upstream end either directly or through the powder pump 4 to a powder feed pipe 70, said pipe being dippable into the manufacturer's container 12 or 14. The powder pump 4 may be mounted at the beginning of, the end of, or in-between, in the fresh powder conduit 16 or 18 or at the upper or lower end of the powder feed pipe 70.

A small fresh powder container in the form of a fresh powder bag 12 is shown in FIG. 1 held in a bag-receiving hopper 74. The bag-receiving hopper 74 keeps the powder bag 12 in a specified shape, the bag opening being at the upper bag end. The bag-receiving hopper 74 may be mounted on a scale or on weighing sensors 76. Such a scale or weighing sensors depending on their design may generate visual displays and/or electrical signals that, following subtraction of the weight of the bag-receiving hopper 74, will correspond to the weight and hence the quantity of the coating powder in the small container 12. Illustratively a minimum of one vibrator 78 is mounted at the bag-receiving hopper 74 to shake it.

Two or more small containers 12 may be configured each in a bag-receiving hopper 74, also two or more large containers 14 operating alternately. This feature allows rapidly changing from a small container 12 to another or to one large container 14.

The invention may be modified in a number of ways without restricting it. For instance the sieve 10 may be integrated into the intermediate receptacle 24. Alternatively the sieve 10 may be omitted when the fresh powder quality is high enough. In that case a separate sieve may be used to sift the recovery powder of the conduits 44 and 50, illustratively upstream or downstream of the cyclone separator 48 or in it. Again, sifting the recovery powder will not be required when its quality is adequate for re-use.

Figure 2:
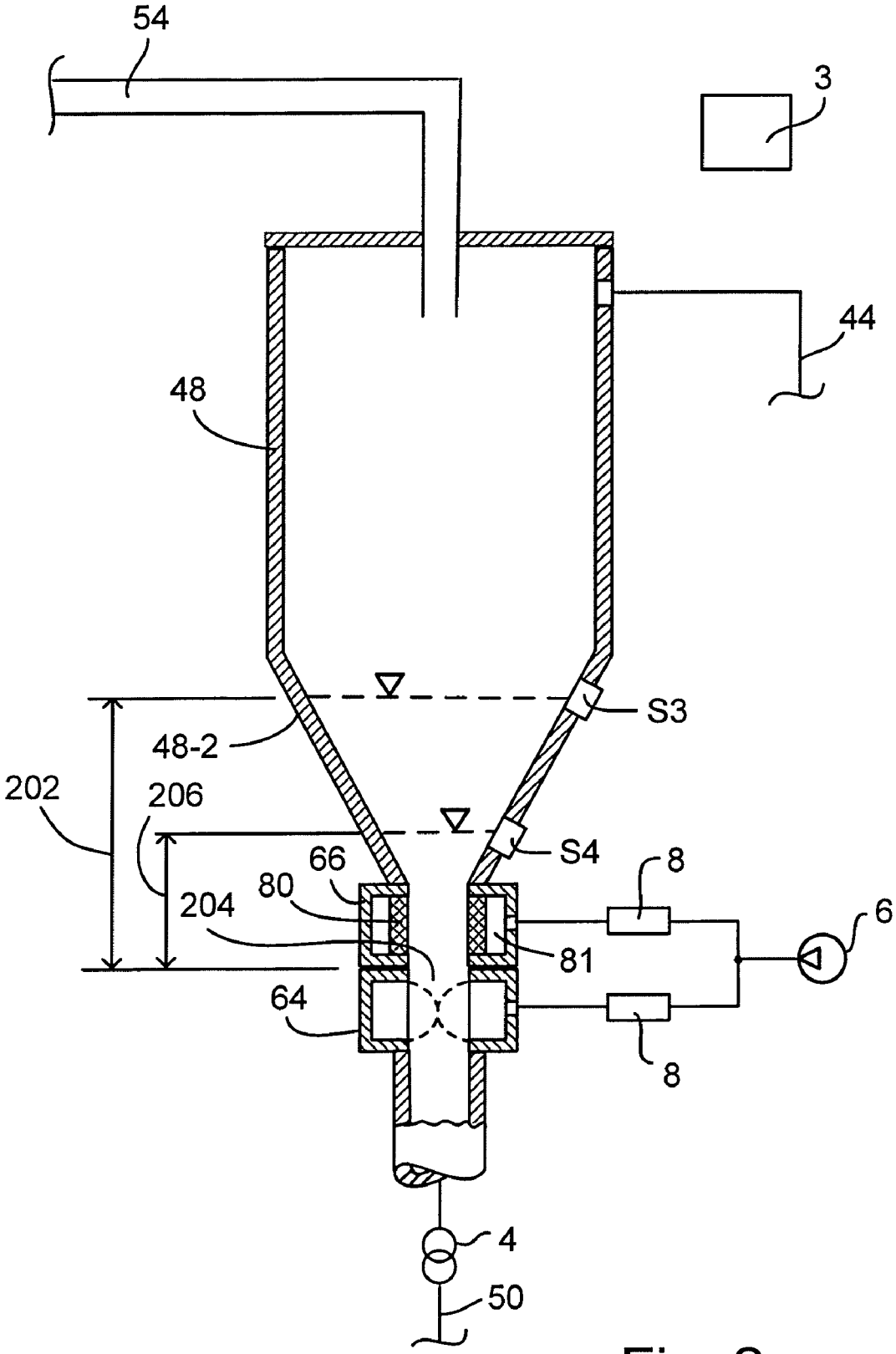

Compared to FIG. 1, FIG. 2 shows the fluidizing unit 66 as on a larger scale. This unit contains a fluidizing wall 80 which is impermeable to the coating powder but permeable to the compressed air and is situated between the powder path at the lower end of supply bin 48-2 and the fluidizing compressed air chamber 81 subtended by the fluidizing wall 80. Compressed air from the compressed air source 6 passes through a control element 8, for instance a valve and/or a pressure regulator, into the fluidizing compressed air chamber 81 and from there through pores or a plurality of very narrow boreholes in the fluidizing wall 80 into the lower terminal element of the end segment 48-2—designed as the supply bin—of the cyclone separator 48. The fluidizing wall 80 may subtend in part or in whole the lower terminal element of the end segment 48-2 above a powder outlet 204 of the end segment 48-2. Two or more fluidizing walls 80 and fluidizing compressed-air chambers 81 may be configured in distributed/arrayed manner along the periphery/circumference of the end segment 48-2 designed as the supply bin. The outlet valve 64 is configured a vertical distance 202 from the test level of the upper sensor 53 and a vertical distance 206 from the test level of the lower sensor S3 of end segment 48-2. The volume of the end segment 48-2 acting as the supply bin situated between the two sensors S3 and S4 defines a predetermined reserve volume for the recovery powder.

Individual components/elements and combined sub-assemblies of components/elements of FIGS. 1 and 2 as well as the description herein always shall also be construed as being advantageously applicable per se also. Illustrative embodiments of the present invention are discussed below.

Embodiment 1

A powder spray coating facility comprises an intermediate receptacle (24) from which coating powder may be pneumatically moved at least to one sprayer (40) The facility further comprises at least one sensor (S1) at the intermediate receptacle to generate a "powder needed" signal when the powder level in the intermediate receptacle (24) has dropped below a predetermined minimum level and a cyclone separator (48) to separate recovery powder from an airflow containing sprayed, excess powder that missed an object being coated. The facility further includes in that a recovery powder supply bin (48-2) configured in the path of the recovery powder from the cyclone separator (48) to the intermediate receptacle (24) acting as an interim storage for the recovery powder in the recovery powder supply bin (48-2) before being fed into the intermediate receptacle. The recovery powder supply bin (48-2) is fitted with at least one supply bin sensor (S3) to generate a recovery powder data signal based on whether the powder level is below a minimum level or at least at it. A fresh-powder feed (70-74) serves to feed unsprayed fresh powder from a fresh-powder container (12; 14) into the intermediate receptacle (24) along at least one powder path which bypasses both the cyclone separator (48) and the powder recovery supply bin (48-2). At least one control (3) is operationally connected to the sensors (S1, S3) to automatically drive the powder spray coating facility and designed in a way that in a first operational mode only recovery powder from the recovery powder supply bin (48-2) is fed into the intermediate receptacle (24), but no fresh powder from the fresh powder feed unit (70, 74), when simultaneously there is a "powder needed" signal from the intermediate receptacle sensor (S1) and a recovery powder data signal from the recovery powder supply bin sensor (S3), the latter signal corresponding to a recovery powder level at or above the predetermined minimum level of recovery powder, whereas in a second operational mode, only fresh powder is fed from the fresh powder supply unit (70, 74) to the intermediate receptacle (24), but no recovery powder from the recovery powder supply bin (48-2) if there is a "powder needed" signal from the intermediate receptacle sensor (S1) and simultaneously there is a recovery powder data signal from the supply bin sensor (S3), where the latter signal corresponds to a recovery powder level below the said minimum level.

Embodiment 2

In addition to embodiment 1, in this embodiment, the at least one supply bin sensor (S3) is configured at such a height on the recovery powder supply bin (48-2) that the recovery powder supply bin comprises a powder reserve segment (202) situated below the supply bin sensor (S3) The powder reserve segment (202) stores a predetermined quantity of reserve recovery powder up to said minimum level.

Embodiment 3

In addition to embodiment 1 or 2, in this embodiment, the at least one control (3) is designed to automatically switch the powder spray coating facility from the second operating mode into reserve operating mode wherein the intermediate receptacle (24) receives only recovery powder from the powder reserve segment (202) of the recovery powder supply bin (48-2) but no fresh powder from the fresh powder supply unit (70, 74) when following a predetermined time delay after switching from the first operating mode to the second operating mode there continues to be a "powder needed" signal from the intermediate receptacle sensor (S1). The at least one control (3) is fitted with a time delay circuit defining the time delay or the time delay is adjusted at said circuit.

Embodiment 4

In addition to embodiment 1, 2 or 3, in this embodiment, the recovery powder supply bin (48-2) is fitted with a second supply bin sensor (S4) generating an emergency signal anytime the recovery powder level in the recovery powder supply bin (48-2) has dropped to a predetermined lower limit level situated at a predetermined distance below the predetermined recovery powder minimum level of the first supply bin sensor (S3).

Embodiment 5

In addition to any preceding embodiment, in this embodiment, the recovery powder supply bin (48-2) is configured underneath the cyclone separator (48). A vertical passage is provided between the recovery powder supply bin (48-2) and the cyclone separator (48) through which the recovery powder is allowed to drop by gravity from the cyclone separator (48) into the recovery powder supply bin (48-2).

Embodiment 6

In addition to any preceding embodiment, in this embodiment, the recovery powder supply bin (48-2) is fitted with a container housing constituted by a lower extension of the housing of the cyclone separator (48).

Embodiment 7

In addition to any preceding embodiment, in this embodiment, the housing of the recovery powder supply bin (48-2) tapers from top to bottom in a frustoconical manner.

Embodiment 8

In addition to any preceding embodiment, in this embodiment, the recovery powder supply bin (48-2) is fitted with a fluidizing unit (66) to fluidize, by compressed air, recovery powder present in the recovery powder supply bin (48-2) The compressed air is fed through the fluidizing unit (66) into the recovery powder supply bin (48-2).

Embodiment 9

In addition to any preceding embodiment, in this embodiment, a blocking device (64) illustratively in the form of at least one pinch valve is mounted at the lower end of the recovery powder supply bin (48-2) alternately to block and open a powder outlet (204).

Embodiment 10

In addition to any preceding embodiment, in this embodiment, the at least one intermediate receptacle sensor (S1, S2) and the at least one supply bin sensor (S3, S4) comprises a powder level sensor generating a said signal as a function of the powder level it detects.

Embodiment 11

In addition to any preceding embodiment, in this embodiment, the fresh powder supply unit (70, 74) is fitted with a sensor (76) generating a first signal—as a function of the quantity of fresh powder in a fresh powder container (12) in the fresh powder supply unit (70, 74).

Embodiment 12

In addition to the preceding embodiment, in this embodiment, the sensor (76) of the fresh powder supply unit (70, 74) is operationally connected to the at least one control (3) and generates a second signal in the at least one control when the quantity of fresh powder in the fresh powder container (12) has decreased to a lower quantity limit value that is a particular distance below a predetermined residual quantity at which said first signal is being generated.

Embodiment 13

In addition to the preceding embodiment, in this embodiment, upon receiving the second signal from the sensor (76) of the fresh powder supply unit (70, 74), the at least one control (3) switches the powder spray coating facility to a mode of reserve operation provided a "powder needed" signal is also generated also by the at least one intermediate receptacle sensor (S1), where, during the reserve mode, only recovery powder from the powder reserve segment (202) of the recovery powder supply bin (48-2) is fed to the intermediate receptacle (24), but no fresh powder from the fresh powder supply unit (70, 74).

Embodiment 14

In addition to embodiment 11, in this embodiment, the sensor (76) of the fresh powder supply unit (70, 74) is operationally connected to the at least one control (3). The at least one control (3) is designed so that in response to the first signal from the sensor (76) of the spray coating facility's fresh powder supply unit (70, 74) the at least one control switches the spray coating facility to the reserve mode provided the at least one intermediate receptacle sensor S1) also generates a "powder needed" signal, where, in the reserve mode only recovery powder from the powder reserve segment (202) of the recovery powder supply bin (48-2) is fed to the intermediate receptacle (24), but no fresh powder from the fresh powder supply unit (70, 74).

Embodiment 15

In addition to embodiment 11, in this embodiment, the sensor (76) of the fresh powder supply unit (70, 74) is operationally connected to the at least one control (3). The at least one control (3) is designed so that, in response to the first signal from the sensor (76) of the fresh powder supply unit (70, 74), the at least one control switches the spray coating facility to a reserve mode provided a "powder needed" signal is also generated by the at least one intermediate receptacle sensor (S1), where in the reserve mode only recovery powder from the powder reserve segment (202) of the recovery powder supply bin (48-2) is fed to the intermediate receptacle (24), but no fresh powder from the fresh powder unit (70, 74), and where the control (3) contains a time delay circuit as a result of which the switching to the reserve mode takes place only after a predetermined time delay following receiving the first signal of the sensor (76) of the fresh powder supply (70, 74).

Embodiment 16

In addition to embodiment 11, in this embodiment, the sensor (76) of the fresh powder supply unit (70, 74) comprises a scale for weighing the fresh powder in a fresh powder container (12).

Embodiment 17

In addition to any preceding embodiment, in this embodiment, a sieve (10) is oriented in the path followed by the recovery powder from the recovery powder supply bin (48-2) to the intermediate receptacle (24).

Embodiment 18

In addition to the preceding embodiment, in this embodiment, the path followed by the fresh powder from the fresh powder supply unit (70, 74) to the intermediate receptacle (24) also passes through the sieve (10), whereby the fresh powder also will be sifted.

Embodiment 19

In addition to embodiments 17 and 18, in this embodiment, a powder pump (4) is oriented in a powder path segment (50) of the recovery powder from the recovery powder supply bin (48-2) to the intake side of the sieve (10).

Embodiment 20

In addition to embodiments 18 and 19, in this embodiment, one powder pump (4) is provided in each powder path segment (16) of the fresh powder, from the fresh powder container (12) of the fresh powder supply unit (70, 74) to the intake side of the sieve (10).

Embodiment 21

In addition to embodiments 17 through 20, in this embodiment, one powder pump (4) is provided in each powder path segment (20) from an output side of the sieve (10) into the intermediate receptacle (24).

Embodiment 22

In addition to any preceding embodiment, in this embodiment, one powder pump (4) is provided in each coating powder path (38) from the intermediate receptacle (24) to the at least one sprayer (40).

Embodiment 23

A powder spray coating method. The method employs the apparatus according to any preceding embodiment. Coating powder is pneumatically moved from an intermediate receptacle (24) to at least one sprayer (40); at least one sensor (S1) at the intermediate receptacle (24) generates a "powder needed" signal when the powder level in the intermediate receptacle (24) drops below a predetermined coating powder level; a cyclone separator (48) separates recovery powder from an airflow, where said recovery powder contains sprayed excess powder that missed an object being coated; on the path from the cyclone separator (48) to the intermediate receptacle (24), the recovery powder is temporarily held in a recovery powder supply bin (48-2), by means of at least one supply bin sensor (S3) a recovery powder data signal is generated as a function of the powder level in the recovery powder supply bin (48-2) being below a minimum level or at least at the minimum level; unsprayed fresh powder is fed from a fresh powder container (12) to the intermediate receptacle (24) along a powder path bypassing the cyclone separator (48) as well as the recovery powder supply bin (48-2); depending on signals transmitted by the sensors (S1, S3) and by means of a control (3), the powder spray coating facility is automatically driven in a first operating mode wherein the intermediate receptacle (24) receives only recovery powder from the recovery powder supply bin (48-2) but no fresh powder from the fresh powder supply unit (70, 74) when the intermediate receptacle sensor (S1) transmits a "powder needed" signal and simultaneously the recovery powder supply bin sensor (S3) transmits a recovery powder data signal which corresponds to a recovery powder level at or above the predetermined minimum level, but switching into a second operating mode automatically takes place and the powder spray coating facility is operated in said second mode whereby only fresh powder from the fresh powder supply unit (70, 74) is fed to the intermediate receptacle (24) but no recovery powder from the recovery powder supply bin (48-2) when the intermediate receptacle sensor (S1) transmits a "powder needed" signal and simultaneously the recovery powder supply bin sensor (3) transmits a recovery powder data signal which corresponds to a recovery powder level below the said minimum recovery powder level.

Embodiment 24

In addition to any preceding embodiment, in this embodiment, a reserve quantity of recovery powder is stored in a lower powder reserve segment (202) of the recovery powder supply bin (48-2) during the first operating mode. Switching from the second operating mode into a reserve operating mode which shall be automatically implemented and during which the intermediate receptacle (24) only receives recovery powder from the reserve quantity of recovery powder of the powder reserve segment (202) but no fresh powder from the fresh powder supply unit (70, 74) when, following a predetermined delay time after switching from the first operating mode to the second operating mode a "powder needed" signal is still being transmitted from the intermediate receptacle sensor (S1).

The invention claimed is:

1. A powder spray coating facility comprising an intermediate receptacle from which coating powder may be pneumatically moved at least to one sprayer; further comprising at least one sensor at the intermediate receptacle to generate a "powder needed" signal when the powder level in the intermediate receptacle has dropped below a predetermined minimum level; a cyclone separator to separate recovery powder from an airflow containing sprayed, excess powder that missed an object being coated, a recovery powder supply bin configured in the path of the recovery powder from the cyclone separator to the intermediate receptacle, the recovery powder supply bin acting as an interim storage for the recovery powder in the recovery powder supply bin before the recovery powder is fed into the intermediate receptacle; the recovery powder supply bin fitted with at least one supply bin sensor to generate a recovery powder data signal based on whether the powder level is at or below a minimum level; a fresh-powder feed which serves to feed unsprayed fresh powder from a fresh powder container into the intermediate receptacle along at least one powder path which bypasses both the cyclone separator and the powder recovery supply bin; at least one control operationally connected to the sensors to automatically drive the powder spray coating facility; the at least one control including a first operational mode in which only recovery powder from the recovery powder supply bin is fed into the intermediate receptacle, but no fresh powder from the fresh powder feed unit, when simultaneously there is a "powder needed" signal from the intermediate receptacle sensor and a recovery powder data signal from the recovery powder supply bin sensor, the recovery powder data signal corresponding to a recovery powder level at or above the predetermined minimum level of recovery powder, the at least one control switching to a second operational mode in which only fresh powder is fed from the fresh powder supply unit to the intermediate receptacle, but no recovery powder from the recovery powder supply bin if there is a "powder needed" signal from the intermediate receptacle sensor and simultaneously there is a recovery powder data signal from the supply bin sensor, where the recovery powder data signal corresponds to a recovery powder level below the said minimum level, wherein the at least one supply bin sensor is configured at such a height on the recovery powder supply bin that the recovery powder supply bin comprises a powder reserve segment situated below the supply bin sensor, the powder reserve segment storing a predetermined quantity of reserve recovery, powder up to said minimum level, and the at least one control automatically switches the powder spray coating facility from the second operating mode into a reserve operating mode wherein the intermediate receptacle receives only recovery powder from the powder reserve segment of the recovery powder supply bin, but no fresh powder from the fresh powder supply unit when, following a predetermined time delay after switching from the first operating mode to the second operating mode, there continues to be a "powder needed" signal from the intermediate receptacle sensor, the at least one control being fitted with a time delay circuit defining the time delay or the time delay being adjusted at said circuit.

2. A powder spray coating as claimed in claim 1 wherein the recovery powder supply bin is fitted with a second supply bin sensor for generating an emergency signal anytime the recovery powder level in the recovery powder supply bin has dropped to a predetermined lower limit level situated at a predetermined distance below the predetermined recovery powder minimum level of the first supply bin sensor.

3. A powder spray coating facility as claimed in claim 1 wherein the recovery powder supply bin is oriented underneath the cyclone separator and a vertical passage is subtended between the recovery powder supply bin and the cyclone separator through which the recovery powder is allowed to drop by gravity from the cyclone separator into the recovery powder supply bin.

4. A powder spray coating facility as claimed in claim 1 wherein the recovery powder supply bin is fitted with a container housing comprising a lower extension of the housing of the cyclone separator.

5. A powder spray coating facility as claimed in claim 1 wherein the housing of the recovery powder supply bin tapers from top to bottom in a frustoconical manner.

6. A powder spray coating facility as claimed in claim 1 wherein the recovery powder supply bin is fitted with a fluidizing unit to fluidize, by compressed air, recovery powder present in the recovery powder supply bin, said compressed air being fed through the fluidizing unit into the recovery powder supply bin.

7. A powder spray coating facility as claimed in claim 1 further including a blocking device in the form of at least one pinch valve mounted at the lower end of the recovery powder supply bin operable alternately to block and open a powder outlet.

8. A powder spray coating facility as claimed in claim 1 wherein at least one of the intermediate receptacle sensor and the supply bin sensor is a powder level sensor generating the said signals as a function of the powder levels it detects.

9. A powder spray coating facility as claimed in claim 1 wherein the fresh powder supply unit is fitted with a sensor generating a first signal as a function of the quantity of fresh powder in a fresh powder container in the fresh powder supply unit when the quantity of fresh powder in the fresh powder container drops below a predetermined residual quantity.

10. A powder spray coating facility as claimed in claim 9 wherein the sensor of the fresh powder supply unit is operationally connected to the at least one control and generates a second signal in the at least one control when the quantity of fresh powder in the fresh powder container has decreased to a lower quantity limit value that is a particular distance below a predetermined residual quantity at which said first signal is being generated.

11. A powder spray coating facility as defined in claim 10 wherein, upon receiving the second signal from the sensor of the fresh powder supply unit, the at least one control switches the powder spray coating facility to a mode of reserve operation provided a "powder needed" signal is also generated by the at least one intermediate receptacle sensor, where, during the reserve mode, only recovery powder from the powder reserve segment of the recovery powder supply bin is fed to the intermediate receptacle, but no fresh powder from the fresh powder supply unit is fed to the intermediate receptacle.

12. A powder spray coating facility as claimed in claim 9 wherein the sensor of the fresh powder supply unit is operationally connected to the at least one control and the at least one control is so designed that in response to the first signal from the sensor of the spray coating facility's fresh powder supply unit the at least one control switches the spray coating facility to the reserve mode, provided the at least one intermediate receptacle sensor also generates a "powder needed" signal, where, in the reserve mode only recovery powder from the powder reserve segment of the recovery powder supply bin is fed to the intermediate receptacle, but no fresh powder from the fresh powder supply unit is fed to the intermediate receptacle.

13. A powder spray coating facility as claimed in claim 9 wherein the sensor of the fresh powder supply unit is operationally connected to the at least one control and wherein the at least one control is designed in a manner that, in response to the first signal from the sensor of the fresh powder supply unit, the at least one control switches the spray coating facility to a reserve mode provided a "powder needed" signal is also generated by the at least one intermediate receptacle sensor, where in the reserve mode only recovery powder from the powder reserve segment of the recovery powder supply bin is fed to the intermediate receptacle, but no fresh powder from the fresh powder unit, and where the control contains a time delay circuit as a result of which the switching to the reserve mode takes place only after a predetermined time delay following receiving the first signal of the sensor of the fresh powder supply.

14. A powder spray coating facility as claimed in claim 1 wherein the sensor of the fresh powder supply unit comprises a scale for weighing the fresh powder in a fresh powder container.

15. A powder spray coating facility as claimed in claim 1 wherein a sieve is oriented in the path followed by the recovery powder from the recovery powder supply bin to the intermediate receptacle.

16. A powder spray coating facility as claimed in claim 15 wherein the path followed by the fresh powder from the fresh powder supply unit to the intermediate receptacle also passes through the sieve, whereby the fresh powder also will be sifted.

17. A powder spray coating facility claimed in claim 15 further including a powder pump oriented in a powder path segment of the recovery powder from the recovery powder supply bin to the intake side of the sieve.

18. A powder spray coating facility as claimed in claim 16 including a powder pump in each said powder path segment of the fresh powder from the fresh powder container of the fresh powder supply unit to the intake side of the sieve.

19. A powder spray coating facility as claimed in claim 15 including one powder pump in each powder path segment from an output side of the sieve into the intermediate receptacle.

20. A powder spray coating facility as claimed in claim 1 including one powder pump in each coating powder path from the intermediate receptacle to the at least one sprayer.

* * * * *